United States Patent [19]

Menter et al.

[11] Patent Number: 4,526,530

[45] Date of Patent: Jul. 2, 1985

[54] BURNER FOR LIQUID CANDLE

[75] Inventors: J. Alan Menter, Fayetteville; Gerald A. Menter, Jamesville, both of N.Y.

[73] Assignee: Hollowick, Inc., Manlius, N.Y.

[21] Appl. No.: 594,336

[22] Filed: Mar. 28, 1984

[51] Int. Cl.[3] ..... F23Q 25/00

[52] U.S. Cl. ..... 431/34; 431/146; 431/321; 431/324; 431/325

[58] Field of Search ..... 431/34, 116, 298, 144, 431/146, 302, 313, 320, 321, 324, 325, 344; 126/260, 265; 222/187

[56] References Cited

U.S. PATENT DOCUMENTS

| | | | |
|---|---|---|---|
| 125,588 | 4/1872 | Mann | 431/321 |
| 181,284 | 8/1876 | Scott | 431/321 |
| 206,904 | 8/1878 | Stephens et al. | 431/321 |
| 830,602 | 9/1906 | Lane | 431/321 |
| 1,957,014 | 5/1934 | Humpoletz | 431/313 |
| 3,321,938 | 5/1967 | Bureau | 431/116 X |
| 3,799,731 | 3/1974 | Novak | 431/313 |
| 3,885,905 | 5/1975 | Giangiulio | 431/34 |
| 3,994,672 | 11/1976 | Novak | 431/320 |
| 4,025,290 | 5/1977 | Giangiulio | 431/324 |
| 4,126,408 | 11/1978 | Cox | 431/320 X |
| 4,261,695 | 4/1981 | Reninger | 431/320 |
| 4,496,307 | 1/1985 | Ginardi | 431/34 |

FOREIGN PATENT DOCUMENTS

| | | | |
|---|---|---|---|
| 2080514 | 2/1982 | United Kingdom | 431/320 |

*Primary Examiner*—Margaret A. Focarino
*Attorney, Agent, or Firm*—Bruns and Wall

[57] ABSTRACT

A burner for a liquid candle having a hollow stud containing a wick. Primary and secondary venting systems having vent openings situated at different elevations are provided to vent vapors generated in the fuel reservoir into the flame region.

18 Claims, 6 Drawing Figures

BURNER FOR LIQUID CANDLE

BACKGROUND OF THE INVENTION

This invention relates to an improved burner for use in a liquid candle and in particular for use in either a disposable or a refillable liquid candle.

The term liquid candle as herein used refers to a heating or lighting device wherein liquid fuel is wicked from a fuel reservoir into a burning region via capillary action where the fuel is vaporized and then ignited to produce a flame about the exposed tip of a wick. The amount of heat or illumination produced by the candle is a function of the wick length that is exposed to atmosphere within the burning region. In many lighting applications, the length of the wick is fixed in the factory to provide a relatively low flame of the type normally associated with a more conventional solid wax candle. A wide variety of liquid fuels can be burned in a liquid candle, however, liquid paraffin is preferred because of its clean burning characteristics. Even when burning a high grade fuel, a liquid candle can produce some out gassing of the fuel vapors. The escape of these vapors to the surrounding atmosphere is objectionable for two reasons. First, many liquid fuel vapors have a clearly discernable, and sometimes unpleasant, odor that may remain in the surrounding atmosphere for long periods of time. Secondly, the escaped vapors can condense on surrounding surfaces thereby "wetting" the host object with an undesirable film. The escape of vapors from the fuel reservoir usually takes place through a vapor vent formed in an otherwise sealed fuel container. The vent is needed to equalize the internal pressure of the container with surrounding atmospheric pressure so that the wicking action can be sustained. Liquid candles utilizing this type of venting arrangement are disclosed in U.S. Pat. Nos. 4,261,695 and 3,799,731.

An early U.S. Pat. No. 545,313 describes a liquid candle that is designed to sustain a low level of illumination over a relatively long period of time. As noted in this patent, low illumination settings as typically used in lamp for providing intimate table lighting, sometimes do not allow for the complete vaporization of the fuel resulting in a wet wick. The unburned fluid brought to the burning zone can cause problems if not efficiently removed from the burning area. A bulb-like chamber is provided in the disclosed burner through which a base wick is passed just prior to its entering the burning zone. The chamber acts as a preheater to promote vaporization of the wicked fuel and also serves to collect any excess fuel brought into the burning zone. A similar type burner for preventing the accumulation of excessive fuel about the exposed tip of the wick is disclosed in U.S. Pat. No. 3,321,938 wherein the fuel is collected in a closed conduit which carries the fuel back to the fuel reservoir. In order for the excess fuel to flow under the influence of gravity back into the fuel reservoir, the conduit opening must be large enough to permit the collected fuel to overcome both the normal surface tension associated with a small vent and the internal pressure found in the reservoir. When the vent is made large enough to permit efficient drainage, it also provides a means through which the fuel can easily escape from the reservoir in the event the unit is tipped either during shipping or normal usage. Large quantities of fuel can thus be lost from the container to the surrounding area where it can cause unwanted damage.

In a U.S. Pat. No. 4,126,408 which issued to Cox, a disposable liquid candle is sealed within a closed fuel container. The burner is a simple metal tube that passes downwardly through the tip of the container into the fuel reservoir. The top of the burner tube is contained within a cylindrical trap that also serves as the male connector for a screw on cap. The burner tube is packed with asbestos at the upper end thereof and a wicking material throughout the lower section. A small position of the wick is exposed below the top of the trap and provides a burning site for a low flame. Any excessive fuel brought to the exposed end of the burner is collected in the trap and returned to the reservoir by means of a drain. The wick is fully enclosed within the trap to enable the cap to be screwed thereon when it is desirous to close and seal the unit.

The use of disposable liquid candles, such as that described by Cox, is highly desirous in restaurants, clubs and other public gathering places because they eliminate many of the problems associated with filling, cleaning and otherwise maintaining a reusable unit. In these disposable units, the wick is generally preset in the factory to provide optimum aesthetic balancing of the flame while still providing for economy of operation. It is also desirous to lock the wick in a preset condition so that it can not be tampered with by patrons or workers. Providing the disposable units with an acceptable shelf life without loss of fuel while at the same time protecting the wick from damage has long been a problem of the art.

SUMMARY OF THE INVENTION

It is therefore an object of the present invention to improve liquid candles.

A further object of the present invention is to provide an improved burner for a liquid candle suitable for use in providing either illumination or heat.

Yet a further object of the present invention is to provide a burner for a liquid candle that is highly efficient yet inexpensive to manufacture.

A still further object of the present invention is to provide an improved liquid candle burner which prevents the escape of vapors from the fuel reservoir of the unit while, at the same time, permitting the reservoir to be vented to atmosphere.

Yet another object of the present invention is to minimize the danger of fire in the event a liquid candle is inadvertantly tipped over while lighted.

Still another object of the present invention is to securely affix the burner of a liquid candle to a fuel storage container using an extremely strong joint that is able to withstand the rigors of shipping and handling.

Yet a further object of the present invention involves an inexpensive, safe and trouble free burner for use in conjunction with a disposable or refillable liquid candle which can be easily sealed for purpose of shipping and/or storing the units.

These and other objects of the present invention are attained by means of a burner that contains a vertically disposed tubular stud that is passed through the top wall of a sealed fuel container for storing a quantity of liquid fuel. A hollow wick holder is held in axial alignment within the stud by means of a radial extended bottom wall to form a cylindrical passage between the walls of the superimposed members. The top surface of the wick retainer is positioned near the top surface of the stud to create a precombustion chamber at the entrance to the passage.

A primary venting system is formed in the bottom wall of the passage which contains one or more small vent openings that will allow vapors generated in the fuel reservoir to move upwardly through the passage into the flame front of the burner where the vapors are consumed. The openings, however, are small enough so that they will not ordinarily permit liquid fuel to flow freely through in either direction. A secondary venting system is passed upwardly from the reservoir through the wick holder which contains one or more vent openings that are smaller than the opening formed in the primary venting system and which serve to relieve the pressure in the reservoir sufficiently to permit liquid fuel collected within the passage to drain back into the reservoir. The combined action of the two venting systems is such as to help minimize loss of liquid fuel from the reservoir should it become inverted, while at the same time permitting excess fuel wicked into the burning zone to be returned to the fuel reservoir.

BRIEF DESCRIPTION OF THE DRAWINGS

For a better understanding of these and other objects of the present invention reference is had to the following detailed description of the invention which is to be read in conjunction with the accompanying drawings, wherein.

DESCRIPTION OF THE INVENTION

Figure 1:
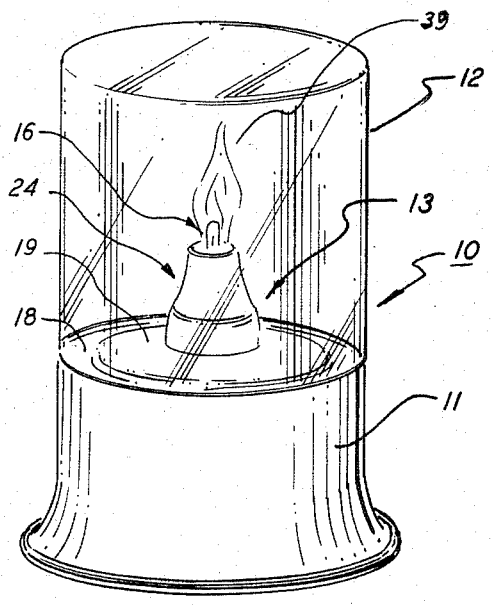
FIG. 1 is perspective view of a decorative table lamp that contains a disposable fuel container and burner unit embodying the teachings of the present invention.
Figure 6:
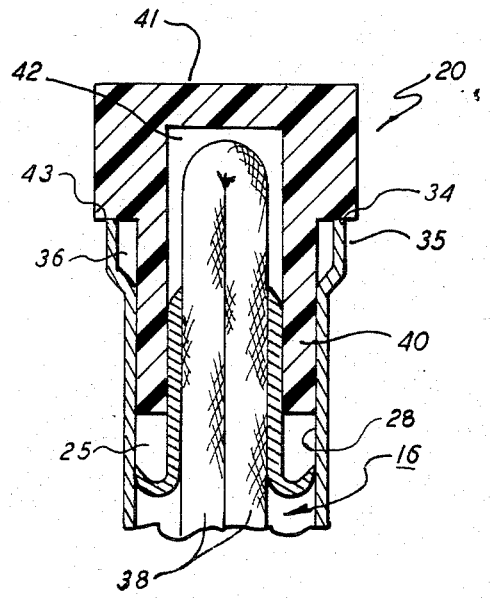
FIG. 6 is also a partial side elevation in a section of the present burner showing a protective seal inserted into the burner.

Turning now to the drawings, there is illustrated a lamp, generally reference 10, in FIG. 1 of the type often times used to provide intimate table lighting in restaurants or the like. The lamp includes a decorative base 11 and a transparent windscreen or chimney 12 that is slidably contained in the base. A disposable liquid candle 13, which embodies the teachings of the present invention, is seated within a recess 18 formed in the base so that the top wall 19 of the container is about level with the top surface of the base. An ornamental snuffer unit 24, the function of which will be explained in greater detail below, is also seated loosely on the top wall of the container so that it encircles the burner of the disposable candle unit. The exposed portion of the burner wick 16 is shown extending upwardly above the snuffer unit to supply fuel to a flame 39. Although in this embodiment of the invention, the liquid candle unit is being used in a lamp to provide illumination, it should be clear to one skilled in the art that the burner can be used equally as well as a low level heater, as for example, in a food warmer or chaffing dish.

Figure 2:
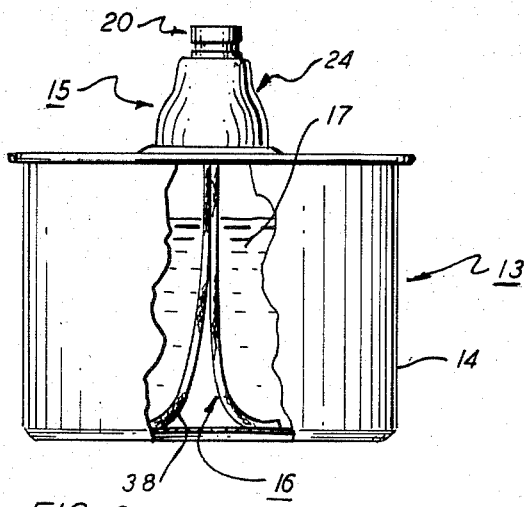
FIG. 2 is an enlarged side elevation of the disposable fuel container and burner unit used in the lamp shown in FIG. 1.
Figure 4:
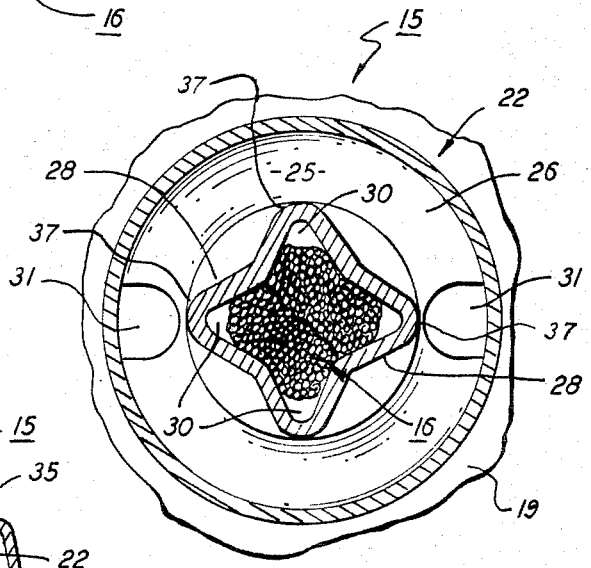
FIG. 4 is a further enlarged section taken along lines 4—4 in FIG. 3 showing a series of open channels passing downwardly adjacent to the wick.

Turning now to FIG. 2 there is shown in greater detail the disposable liquid candle unit 13 utilized in the lamp 10. The unit includes a generally sealed fuel container 14 that forms a reservoir 17 in which a quantity of liquid fuel is stored. Mounted upon the top wall of the container is a vertically disposed burner assembly generally referenced 15. The previously noted snuffer unit 24 forms a part of the burner assembly. A wick 16 which can be either consumable or non-consumable extends downwardly from the burner into the fuel reservoir. The lower end of the wick is split into two sections 38—38 which are turned laterally along the bottom wall of the reservoir so that the wick is able to draw substantially all of the fuel from the reservoir into the burning zone. Preferably the fuel is formulated from liquid paraffin waxes that are relatively clean burning and odorless. Fuels of this type are commercially available through Hollowick, Inc. of Manlius, N.Y. Because of the unique venting system employed in the present unit, less desirable types of fuels can, however, be utilized without producing objectionable outgassing of fuel vapors. The present unit is illustrated in FIG. 2 in a stored configuration wherein a relatively inexpensive protective seal 20 is inserted into the burner over the top of the wick. When the unit is installed in a lamp or the like, the protective seal is simply removed from the burner to expose the tip of the wick.

Figure 3:
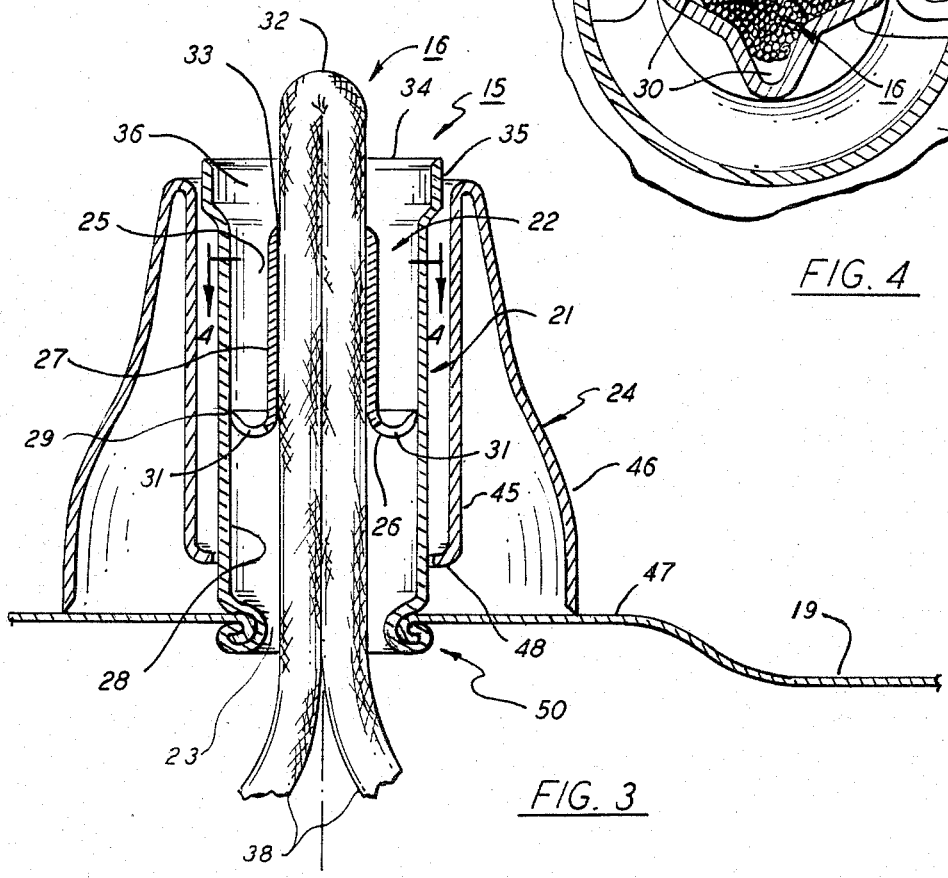
FIG. 3 is a further enlarged section taken through the vertical axis of the burner shown in FIG. 2.

Turning now to FIG. 3, the burner 15 is shown mounted in the top wall 19 of the sealed fuel container 14. The central element of the burner assembly is a tubular stud 21 that is passed into a hole 23 centrally formed in the raised section 47 of the top wall 19. The bottom edge of the stud is interlocked and crimped in place using well known joining techniques within the peripheral edge of the hole to form an extremely strong double seamed rivet joint 50 capable of supporting the stud in a vertical position over the wall as shown. Similar joints of this nature are shown in U.S. Pat. Nos. 4,055,133, 3,417,573 and 3,390,738. The interior region of the otherwise sealed container is able to communicate with the surrounding ambient atmosphere through means of the hollow stud. The joint is mechanically closed to render it leak proof both to liquids and vapors. Although the present burner is shown herein being securely affixed to the top wall of a disposable container it should be clear that the burner may be similarly affixed to the screw on cap of a refillable unit without departing from the teachings of the present invention.

A hollow wick retainer 22 is housed within the tubular stud in axial alignment therewith. The wick retaining member includes an elongated body section 27 which terminates in a radially extended bottom wall 26. The outer edge 29 of the wall is contoured to provide an interference fit with the inside wall surface 28 of the stud. In assembly, the wick holder is press fitted into the stud to a depth whereby the top edge 33 of the holder is preferably situated below the top edge 34 of the stud. The top section of the stud is expanded outwardly in a radial direction to create a bell-like flange 35 that generally describes an open topped precombustion chamber 36. An elongated cylindrical passage 25 is established between the body section 27 of the wick holder and the inside wall surface 28 of the stud. As can be seen, the passage opens directly into the precombustion chamber 36.

A primary venting system for relieving vapor from the fuel reservoir is provided in the bottom wall 26 of the wick holder. The primary system includes one or more vent openings 31—31 that serve to place the fuel reservoir in communication with the surrounding atmosphere through means of the cylindrical passage 25 and the precombustion chamber 36. Vapors generated in the container are thus vented to atmosphere thereby holding the internal pressure of the container at atmospheric pressure. By maintaining an equilibrium pressure inside the fuel reservoir the wick is allowed to efficiently draw fuel via capillary action from the reservoir into the burning zone. The size of each primary vent opening is closely controlled to prevent fuel from freely flowing out of the reservoir in the event the container is tipped over. Each vent opening is sized so that the surface tension between the fuel and the opening, absent any other force, will be sufficient to prevent the fuel from flowing freely from the reservoir into the passage. A vent opening having a width of about 0.020 inches has been found sufficient to prevent ready passage therethrough of most high paraffin fuels.

As best seen in FIG. 3, the wick 16 passes upwardly through the center of the wick holder 22. In assembly, the wick is doubled over at its approximate mid-point to form the exposed tip section 32 that supports the flame front when the burner is lighted. Preferably the wick has wire filaments woven into its fabric which provided added beam strength to the free standing exposed section and which also allows the generally flacid wick materials to be set so that the exposed section 32 of the wick can be repeatably shaped as shown to insure consistancy in the burner's flame characteristics. In the present embodiment of the invention, the exposed section 32 of the wick is arranged to pass upwardly through the precombustion chamber, however, the top edge of the wick holder can be brought to the level of the top surface of the tubular stud or even beyond without adversely effecting the burning properties of the burner.

The central opening of the wick holder is made wide enough so that the doubled over wick can pass freely therethrough with some clearance between the wick surfaces and the inner wall of the holder. The top part of the wick holder body 27 is crimped inwardly at equally spaced intervals to form four concave indentations 28—28. The indentations are deep enough to securely lock the wick within the holder and thus prevent the wick from being pulled out of the holder body. The height of the wick is normally adjusted during assembly to provide for a balance in illumination and efficient burning.

The crimping operation also creates a secondary venting system in the form of four small vent channels or openings 30—30 that are formed at the edges 37—37 of the cojoined crimped sections. The channels pass downwardly along the surface of the wick and empty through the wick holder into the fuel reservoir Here again the size of the channel openings is controlled so that the width of each opening is less than the width openings found in the primary venting system. Accordingly, fuel contained in the reservoir will not freely flow through the channel in the event the container is tipped over. The secondary venting system is designed to operate as a stand pipe in the assembly, to relieve the pressure in the reservoir in the event the cylindrical passage 25 becomes flooded with liquid fuel. Under the combined venting action of the secondary system and the slight head pressure built up by liquid fuel collected in the passage, the surface tension built up about the primary vent openings is overcome, before the passage fills thereby enabling the collected fuel to drain into the reservoir. Once the passage starts to drain it will normally continue to drain until all of the fuel is completely removed from the passage.

Figure 5:
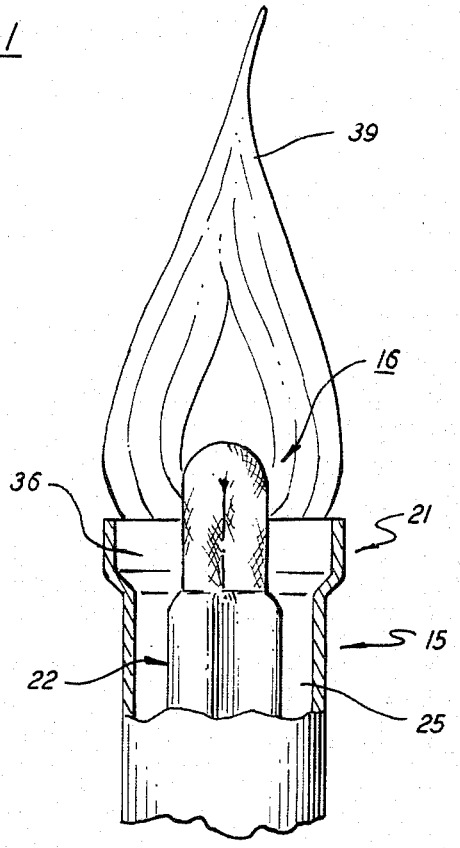
FIG. 5 is a partial side elevation with portions broken away showing the flame geometry developed by the exposed wick utilized in the present burner.

As illustrated in FIG. 5, the flame 39 produced by the burner eminates outward from the exposed end of the wick and upwardly from the top of the precombustion chamber 36. The diameter of the tubular stud surrounding the chamber prevents sufficient oxygen from reaching this region to support combustion in the chamber, however, the surfaces surrounding the chamber become heated during the burning process to preheat both air and fuel vapors in the chamber to an elevated temperature whereby the heated mixture aids in the burning to provide for a highly efficient burner. As should also be evident, the entrance to the primary venting system is completely covered by the flame so that all vapor vented during combusion is quickly consumed.

As noted above, a removable protective seal 20, is also provided as part of the burner assembly. The seal is slidably received within the stud of the burner and forms a protective shield which prevents the preset wick from being damaged when the burner is not in use as for example during periods when the unit is being shipped or stored. The seal includes a hollow shank 40 that depends downwardly from an expanded head 41. A blind hole 42 passes upwardly through the shank into the head which allows the exposed end of the wick to be received therein. The outside diameter of the shank is slightly greater than the inside diameter of the stud so that an interference fit is provided between the two surfaces. The protective seal is formed of a plastic material that is able to deform sufficiently to allow the seal to be easily inserted and removed from the burner by hand. The fit between the two surfaces, however, is tight enough to provide both a fluid tight and vapor tight seal where the shank is contained within the stud as shown. The width of the head 41 is greater than the width of the precombustion chamber so that the shoulder 43 of the head will contact the top of the flange 35 before the wick bottoms against the receiving hole 42 thereby preventing the wick from being deformed or otherwise damaged when the seal is in place.

A snuffer unit 45 loosely encircles the stud of the burner assembly as illustrated in FIG. 3. The snuffer unit includes an outer stand 46 of decorative design that is adopted to rest upon the raised section 47 of the container top wall 19 when the container is seated upon a relatively flat horizontal surface. A cylindrical snuffer tube 45 is suspended inside the stand from the top surface thereof so that the snuffer tube hangs down adjacent to the outer wall surface of the stud. The inside diameter of the snuffer tube is slightly greater than the outside diameter of the expanded flange 35 thereby enables the snuffer to move axially over the flange.

The bottom of the snuffer tube terminates with an inwardly turned annular stop 48 that is capable of contacting the flange 35 at the top of the tubular stud and thus prevent the snuffer tube from sliding completely off the stud. In the event the container is tipped over when the burner is lighted, the snuffer tube will automatically slide along the stud to encompass the flame. The inside diameter of the snuffer tube is sufficiently narrow so that when the tube is extended outwardly over the wick the flame is starved of oxygen and is quickly extinguished.

While this invention has been described with specific reference to the details as set forth above, it is not intended to be limited to this specific structure and the invention is intended to cover any modifications or changes that may come within the scope of the following claims.

We claim:

1. Burner apparatus for use in association with a liquid candle having a closed container that forms a liquid fuel reservoir, the apparatus including a hollow stud that is vertically mounted within an opening formed in the top of the container so that the stud is disposed above the container, a hollow wick holder contained within the stud to form an elongated passage between the inside wall of the stud and the outside wall of the holder, a radially disposed closure wall in the bottom of said passage which is in sealing engagement with the stud and the holder, a primary venting means that includes at least one primary vent opening passing through the closure wall to place the passage in communication with the interior of the container, a wick passing upwardly from the fuel reservoir through the holder to a predetermined elevation above the stud so that the wick flame completely covers the top entrance to said passage and, a secondary venting means passing upwardly through the holder having at least one secondary vent opening that is positioned at a higher elevation than the said at least one primary vent opening whereby the interior of the container is vented through the secondary venting means in the event the said passage between flooded with excess liquid fuel.

2. The apparatus of claim 1 wherein each primary vent opening has a cross sectional area such that the surface tension between the liquid fuel and the edge of each vent opening allows the fuel to bridge the opening whereby fuel in the reservoir is prevented from freely passing through said vents when the container is tipped.

3. The apparatus of claim 1 that further includes locking means for immovably securing the wick within the holder.

4. The apparatus of claim 1 wherein said wick further includes a plurality of metal fibers for adding beam strength to the wick and for permitting the wick to be preset to a desired shape.

5. The apparatus of claim 1 that further includes a snuffer tube loosely surrounding the vertically disposed stud whereby the snuffer tube is able to slide axially over the flame when the container is tipped.

6. The apparatus of claim 5 wherein the snuffer tube is suspended from a stand adapted to rest upon the top of said container.

7. The apparatus of claim 5 wherein said stud includes a radially extended flange at the top thereof and said snuffer tube includes a stop means at the bottom thereof that is capable of contacting the flange to prevent the snuffer tube from being completely removed from the said stud.

8. The apparatus of claim 1 that further includes a removable cap having a shank that is insertable into the stud to seal the said passage and a blind hole passing upwardly into the shank for protectively housing the wick when the cap is inverted into the passage.

9. The apparatus of claim 8 wherein said cap further includes a radially extended head that seats against the top of the stud when the shank is sealed within said stud.

10. The apparatus of claim 1 wherein the wall of said stud is interlocked with a container wall by a double seamed leak tight joint having greater strength than the stud wall and the container wall.

11. The apparatus of claim 1 wherein the area of the said at least one primary vent opening associated with the primary venting means is greater than that associated with the secondary venting means.

12. The apparatus of claim 11 wherein the width of the said at least one primary vent opening associated with said primary venting means is about 0.020 inches.

13. The apparatus of claim 12 wherein the width of the passage is slightly larger than the width of said at least one primary vent opening associated with said primary venting means whereby liquid fuel collected in the passage can quickly build up a head pressure over said opening.

14. A burner for use in a liquid candle having a container for storing liquid fuel, said burner including a hollow stud mounted in the top of the container so that the stud is vertically disposed above the container, a hollow wick holder being fully contained inside the stud with the outside wall of the holder forming an elongated flow passage with the inside wall of the stud, a horizontally extended closure wall at the base of the wick holder that is locked against the inside wall of the stud to position the top of the holder just beneath the top of the stud to form an upper entrance to the flow passage, a wick contained in the holder, the tip of the wick being located a predetermined distance above the top of the stud so that the wick flame completely envelopes the entrance to the flow passage when the wick is lighted and the bottom of the wick being immersed in the liquid fuel, stored in the container, and said closure wall further including a primary venting means passing therethrough to allow fuel vapor in the container to move upwardly through the flow passage into the passage entrance where it is consumed by the flame and to allow liquid fuel drawn to the top of the wick to move downwardly through the passage and be returned to the container.

15. The burner of claim 14 that further includes a secondary venting means passing upwardly through the holder having at least one secondary vent opening that is positioned at a higher elevation than the primary venting means whereby fuel vapors can move through the secondary venting means when the flow passage is flooded with liquid fuel.

16. The burner of claim 14 that further includes a snuffer tube loosely surrounding the stud that passes over the wick in the event the container is tipped to extinquish the flame.

17. The burner of claim 14 wherein the stud is interlocked with the top wall of the container to form a double seamed joint for supporting the stud in an upright position.

18. The burner of claim 14 that further includes a removable cap having a shank that is press fitted into the flow passage to seal said passage.

* * * * *

UNITED STATES PATENT AND TRADEMARK OFFICE

CERTIFICATE OF CORRECTION

PATENT NO. : 4,526,530

DATED : July 2, 1985

INVENTOR(S) : J. ALAN MENTER and GERALD A. MENTER

It is certified that error appears in the above-identified patent and that said Letters Patent is hereby corrected as shown below:

Column 7, line 32 "between" should read --becomes--.

Signed and Sealed this

*Eighteenth* Day of *February 1986*

[SEAL]

*Attest:*

*Attesting Officer*

DONALD J. QUIGG

*Commissioner of Patents and Trademarks*